US009387495B2

(12) United States Patent
Schumacher et al.

(10) Patent No.: US 9,387,495 B2
(45) Date of Patent: Jul. 12, 2016

(54) SHOWER DEVICE

(71) Applicant: Kohler Co., Kohler, WI (US)

(72) Inventors: Jeffrey A. Schumacher, Port Washington, WI (US); James J. Barczynski, Kohler, WI (US); Herbert V. Kohler, Jr., Kohler, WI (US)

(73) Assignee: Kohler Co., Kohler, WI (US)

( * ) Notice: Subject to any disclaimer, the term of this patent is extended or adjusted under 35 U.S.C. 154(b) by 545 days.

(21) Appl. No.: 13/705,977

(22) Filed: Dec. 5, 2012

(65) Prior Publication Data

US 2013/0092752 A1 Apr. 18, 2013

Related U.S. Application Data

(63) Continuation-in-part of application No. 13/474,968, filed on May 18, 2012, now abandoned.

(60) Provisional application No. 61/519,357, filed on May 20, 2011.

(51) Int. Cl.
*B05B 1/30* (2006.01)
*B05B 1/18* (2006.01)

(52) U.S. Cl.
CPC ... *B05B 1/30* (2013.01); *B05B 1/18* (2013.01); *B05B 1/3013* (2013.01)

(58) Field of Classification Search
CPC ..... B05B 1/30; B05B 1/3013; B05B 1/18; E03C 1/0409; E03C 2001/026
USPC ..... 239/154, 574, 436, 444, 445, 446, 447, 239/562, 586; 137/625, 625.3, 625.33, 137/625.36, 625.37, 625.14, 625.29; 251/205, 206
See application file for complete search history.

(56) References Cited

U.S. PATENT DOCUMENTS 4,191,332 A 3/1980 De Langis et al.
4,193,553 A 3/1980 Kelly et al.
5,383,604 A * 1/1995 Boesch ..... 239/447
(Continued)

FOREIGN PATENT DOCUMENTS

CN 201720146 U 1/2011
WO 20101038201 4/2010

OTHER PUBLICATIONS

International Search Report and Written Opinion for Application No. PCT/US2012/038502 dated Aug. 3, 2012 (7 pages).
(Continued)

*Primary Examiner* — Arthur O Hall
*Assistant Examiner* — Viet Le
(74) *Attorney, Agent, or Firm* — Michael Best & Friedrich LLP

(57) ABSTRACT

A shower device, such as a hand shower, includes a housing having an inlet and an outlet, the housing defining a first flow path and a second flow path between the inlet and the outlet, a first flow regulator positioned in the first flow path and limiting a flow of water therethrough to a first flow rate, and a second flow regulator upstream of the first flow regulator and limiting a flow of water therethrough to a second flow rate, the first flow path and the second flow path passing through the second flow regulator. A valve may be positioned in the second flow path and biased to close the second flow path and an actuator may be coupled to the valve and operable to open the valve, the actuator being positioned on the housing flush with or recessed from the housing surface.

31 Claims, 5 Drawing Sheets

(56) References Cited

U.S. PATENT DOCUMENTS

| | | | | |
|---|---|---|---|---|
| 5,653,260 | A | 8/1997 | Huber | |
| 5,702,057 | A | 12/1997 | Huber | |
| 5,772,120 | A | 6/1998 | Huber | |
| 5,967,417 | A | 10/1999 | Mantel | |
| 6,016,836 | A * | 1/2000 | Brunkhardt | 137/624.11 |
| 6,233,758 | B1 | 5/2001 | Jeong | |
| 6,732,957 | B2 | 5/2004 | Kanaya et al. | |
| 7,694,898 | B2 | 4/2010 | Munoz Huerta et al. | |
| 7,854,399 | B2 | 12/2010 | Sirkin | |
| 2003/0226600 | A1 * | 12/2003 | Stares et al. | 137/625.3 |
| 2006/0219822 | A1 | 10/2006 | Miller et al. | |
| 2008/0156888 | A1 | 7/2008 | Gilmore | |
| 2008/0272203 | A1 | 11/2008 | Leber | |
| 2008/0289097 | A1 | 11/2008 | Jeong | |
| 2009/0127353 | A1 | 5/2009 | Meisner et al. | |
| 2009/0194612 | A1 | 8/2009 | Mang | |
| 2009/0194613 | A1 | 8/2009 | Mang | |
| 2010/0139798 | A1 | 6/2010 | Schooley, Jr. | |
| 2010/0148104 | A1 | 6/2010 | Ho-Yeong | |
| 2010/0264237 | A1 | 10/2010 | Engel | |
| 2010/0314468 | A1 | 12/2010 | Han | |

OTHER PUBLICATIONS

Eco Button product sheet, GROHE, Known at least as early as May 20, 2011, 1 page.

Flowise Water Conserving Showerheads, American Standard, 2008, 4 pages.

Rainshower Next Generation Eco, GROHE, Known at least as early as May 20, 2011, retrieved from the Internet <URL: http://www.grohe.com/us/5868/showers/hand-showers-shower-sets/rainshower-eco/> 2 pages.

1st Office Action from the State Intellectual Property Office of the People's Republic of China for Application No. 201280024543.6 dated May 27, 2015 (9 pages).

* cited by examiner

SHOWER DEVICE

CROSS REFERENCE TO RELATED APPLICATION

This application is a continuation-in-part of prior-filed, co-pending U.S. application Ser. No. 13/474,968, filed May 18, 2012, which claims the benefit of prior-filed, U.S. Provisional Application No. 61/519,357, filed May 20, 2011, the entire contents of both of which are hereby incorporated by reference.

FIELD

The present invention generally relates to shower devices and, more particularly, to a shower device having a regulated output flow of water.

SUMMARY

Showering products exist in the marketplace that have spray modes with different flow rates for water conservation. However, these products remain at the selected flow rate until the user selects a new function or turns off the shower. An example of such a product is the FloWise by American Standard Company.

In one independent aspect, a shower device, such as a hand shower device, may generally include a first flow path and a first flow regulator positioned in the first flow path. The hand shower device may also include a second flow path and a second flow regulator positioned upstream of the first flow regulator. The first and second flow paths pass through the second flow regulator.

In another independent aspect, a hand shower device may generally have a first flow passage configured to provide a first flow rate of water and a second flow passage configured to provide a second flow rate of water. The hand shower device may be operational in a low flow mode, for providing water at the first flow rate, and in a high flow mode, for providing water at a total flow rate which is the sum of the first flow rate and the second flow rate.

In yet another independent aspect, a hand shower device may generally include a handle and primary flow path for directing a first portion of water flow and a supplemental flow path for directing a second portion of the water flow. A valve may be positioned in the supplemental flow path and configured to be normally closed by a pressure of the second portion of the water flow. An actuator may be coupled to the valve for opening the valve and may be positioned one of flush with and recessed from a surface of the handle.

In an further independent aspect, a shower device may generally include a housing; a primary flow path for directing a first portion of fluid flow; a supplemental flow path for directing a second portion of the fluid flow; a valve positioned in the supplemental flow path and operable to close the supplemental flow path; and an actuator coupled to the valve and operable to open the valve, the actuator including a flexible membrane having outer edges fixedly coupled to the housing, the flexible membrane flexing between a first position, in which the supplemental flow path is closed, and a second position, in which the supplemental flow path is open.

Independent aspects of the invention will become apparent by consideration of the detailed description, claims and accompanying drawings.

DESCRIPTION

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

Figure 1:
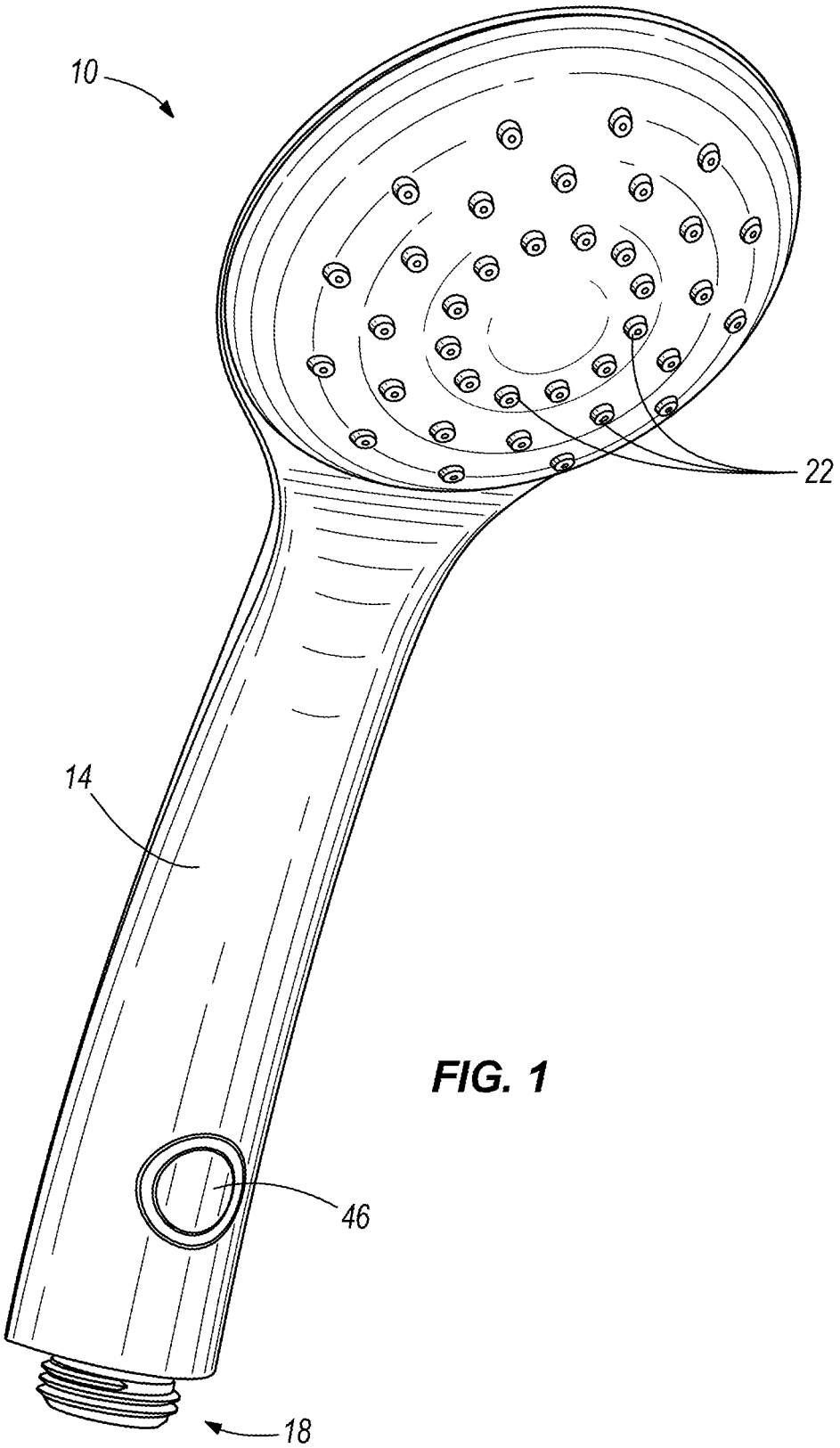
FIG. 1 is a perspective view of a shower device, such as a handshower.

FIG. 1 illustrates a shower device 10 having a handle 14 providing a grip for a user to grasp. The illustrated shower device 10 includes a hand shower device. In other constructions (not shown), the shower device 10 may include a different shower device, such as, for example, a shower head, a rain can, a wall-mounted water tile, etc. The shower device 10 includes an inlet 18 fluidly connected to a plurality of outlet nozzles 22. The inlet 18 is coupled to a fluid conduit 26 for receiving a flow of water from a water supply (not shown).

Figure 2:
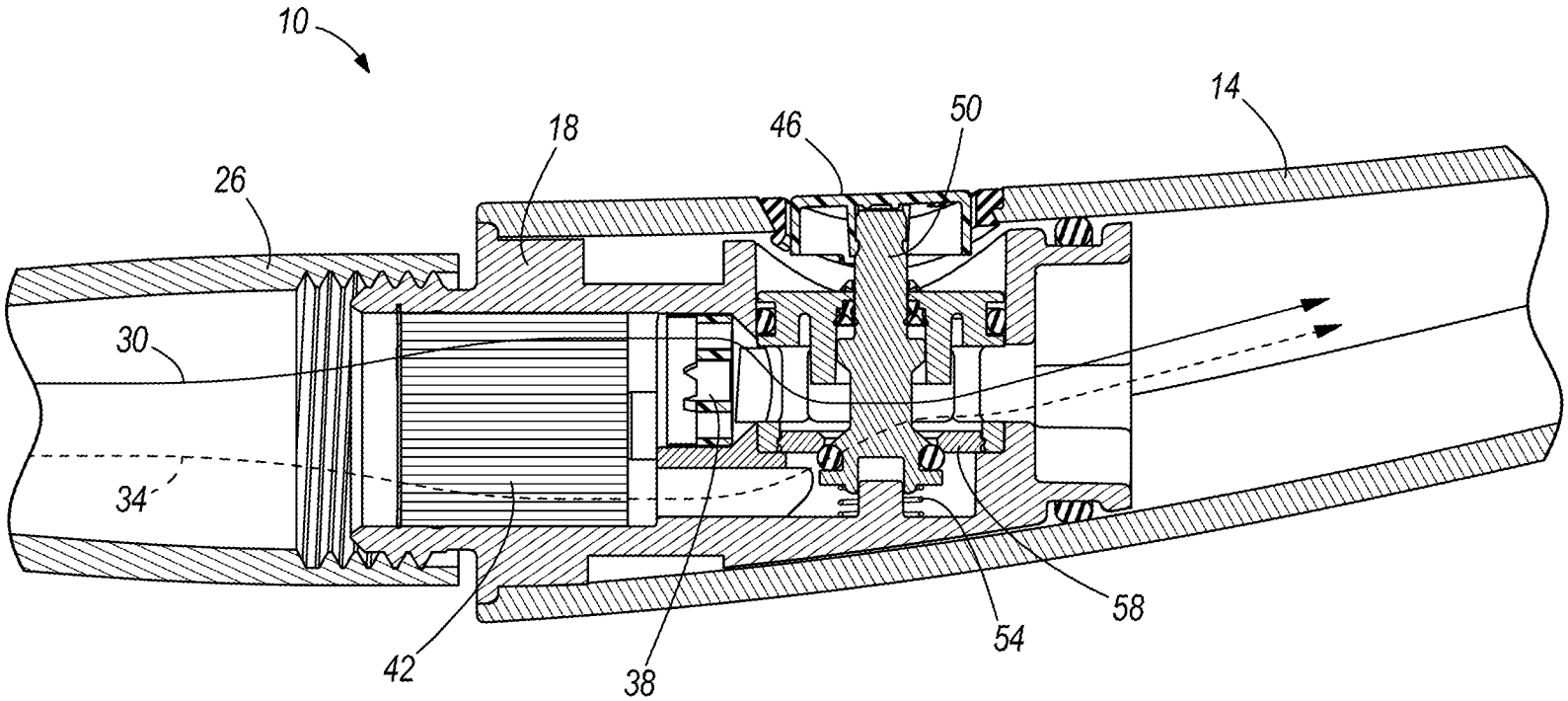
FIG. 2 is a cross sectional view of a portion of the shower device shown in FIG. 1.

FIG. 2 illustrates a cross section of a portion of the shower device 10 in the area of the handle 14 and the inlet 18. The shower device 10 includes a primary flow path 30 and a selectively openable supplemental flow path 34 for providing a higher rate of total flow at the outlet nozzles 22 than the primary flow path 30 alone. In the illustrated construction, at least a portion of the flow paths 30, 34 is defined by the inner surface of the handle 14. In other constructions (not shown), the shower device 10 may include one or more separate waterways extending through the handle 14, such that the water will not directly contact the inner surface of the handle 14.

The shower device 10 includes two pressure compensating flow control devices: a primary regulator 38 and a secondary or supplemental regulator 42. The primary and supplemental regulators 38, 42 limit the flow rate of water passing therethrough, e.g., the regulators 38, 42 self-close as the pressure on the upstream side rises to limit the flow rate therethrough.

The primary flow path 30 directs fluid having a flow rate regulated by the primary regulator 38. Thus, the primary regulator 30 maintains low flow rate, i.e., a low flow mode, suitable for most showering functions (wetting, warming, etc). In the low flow mode, the supplemental flow regulator 42 is in effect disabled because the primary regulator 38 governs the flow at a lower rate than that regulated by the supplemental regulator 42.

The supplemental flow path 34 directs fluid having a flow rate regulated by the supplemental regulator 42. The supplemental regulator 42 provides a higher flow rate limit than the primary regulator 38 and is positioned upstream of the primary regulator 38 and in series with both the primary regulator 38 (i.e., the primary flow path 30) and the supplemental flow path 34. In other words, both the primary and supplemental flow paths 30, 34 pass through the supplemental regulator 42. Thus, the supplemental regulator 42 regulates the sum of the flow rates through the primary and supplemental flow paths 30, 34. In contrast, only the primary flow path 30 passes through the primary regulator 38, and, thus, the primary regulator 38 only regulates the flow rate through the primary flow path 30.

The supplemental flow path 34 is normally closed. An actuator or button 46 is coupled to a momentary valve member 50 which, when seated against a valve seat 58, closes the supplemental flow path 34. In the illustrated construction, the valve seat 58 is an integral part of the inlet 18 of the shower device 10. In other constructions (not shown), the shower device 10 could include a separate valve body providing the valve seat 58 and supporting the valve member 50.

The valve member 50 is biased to a closed position (shown in FIG. 2) to close the supplemental flow path 34. In the illustrated construction, the valve member 50 is biased closed by the pressure of the fluid in the supplemental flow path 34. A spring 54 may optionally be used to influence the force required to actuate the button 46. The spring 54 is disposed between the valve member 50 and a fixed inner surface of the shower device 10.

As mentioned above, in the illustrated construction, the primary flow path 30 is always open. When the button 46 is in the depressed, or actuated position, the shower device 10 is placed in a high flow mode. When a user depresses the button 46, the supplemental flow path 34 is opened, causing an incremental increase in flow from the outlet nozzles 22. The secondary regulator 42 prevents the sum of the primary and supplemental flow paths 30, 34 from exceeding a specified flow rate. Thus, the supplemental flow path 34 adds to the flow from the shower device 10 when a user depresses the button 46.

When a user releases the button 46, the supplemental flow path 34 is automatically closed by the water pressure (and by the spring 54, if provided) acting upon the valve member 50 to move the valve member 50 into engagement with the valve seat 58 to close the supplemental flow path 34. Thus, the shower device 10 returns to the low flow mode upon release of the button 46. In other constructions (not shown), the button 46 may move in a different manner between the closed and open positions (e.g., slide along the handle 14, slide transverse to the handle 14, etc.).

In other constructions (not shown), the shower device 10 may provide more than two flow modes (e.g., low, medium and high flow modes). In such constructions, the shower device 10 will similarly include a number of flow paths corresponding to the flow modes. A primary flow path will be open to provide the low flow mode. Supplemental flow paths will be selectively opened to provide first the next flow mode (e.g., a medium flow mode, a combination of flows through the primary flow path and the first supplemental flow path) and then the subsequent flow mode(s) (with the additional flow through the subsequent flow path(s)). Operation of these flow modes may be valve-controlled in a similar manner.

In the illustrated construction, the button 46 is flush with the surface of the handle 14 (or the housing) of the shower device 10 to inhibit fixation of the shower device 10 in the high flow mode. Accordingly, the high flow mode can only be used "momentarily" while the button 46 is intentionally actuated by the user. In other constructions (not shown), the button 46 may be recessed below the surface of the handle 14.

Other showering products that are controlled by push buttons or levers are typically able to be "fixed" in the high flow mode, for example, by way of tape or a clamping device. The present shower device 10 provides a button 46 that is flush or sub-surface and that can only be actuated by intentionally actuating the button 46. The shower device 10 also reverts back to the low flow mode when the user releases the button 46. The button 46 is flush, or below, the handle surface 14 to, for example, prevent accidental actuation, discourage tampering by holding the button 46 in the open, high flow position by tape, clamp or other means, etc.

The shower device 10 may provide the consumer with an active water saving shower mode, which can be temporarily over-ridden to provide a momentary increase in performance for specific showering tasks. As mentioned above, a primary spray exits the outlet nozzles 22 when the shower device 10 is in the low flow mode, i.e., with flow through the primary flow path 30 only. The primary spray is intended to wet and warm the bather while consuming a minimum amount of water. When the bather has the need for greater flow (e.g., rinsing of shampoo, cleaning of the shower stall, etc.), the flow can be momentarily increased by actuating the button 46 to open the supplemental flow path 34.

It is typical to control a dual rate hand shower by simply opening or closing an orifice to alter the flow rate. Such devices are flawed because the change in flow will be greatly dependent upon the supply pressure of the system, and, accordingly, the device will not perform adequately in both pressurized and gravity water systems. The use of multiple pressure compensating flow control devices, such as the primary and supplemental regulator 38, 42, described above, will maintain regulated flow in all spray modes, allowing the shower device 10 to be used in both high pressure and gravity feed systems.

In the illustrated construction, the two flow modes (low flow and high flow) are achieved by addition of flow through a supplemental water way/flow path 34, rather than by switching between two independent flow paths. In one example, a low flow mode may provide a flow rate of up to 1.4 gallons per minute (gpm), and a high flow mode may provide a flow rate of up to 2.0 gpm. A device having two independent flow paths would require a high-flow path sized to accommodate 2.0 gpm and a separate low-flow path to accommodate 1.4 gpm. In contrast, in the present shower device 10, the primary regulator 38 allows a flow rate of up to 1.4 gpm through the primary flow path 30, and the supplemental flow path 34 need only be sized to accommodate the additional flow of up to 0.6 gpm in order to provide a total high-rate flow of 2.0 gpm from the outlet nozzles 22 during the high flow mode. This reduces the size of the supplemental flow path 34, allowing the components of the shower device 10 to fit in a smaller package.

Due to the relatively small area needed for supplemental flow path 34, a smaller force may be required to open the valve member 50. When the button 46 is not depressed, water pressure will aid in keeping the valve member 50 closed. Because water pressure is used to hold the valve member 50 closed, a return spring may not be necessary to overcome the actuating force. As described above, the return spring 54 may optionally be used to influence the force required to activate the button 46.

Figure 4:
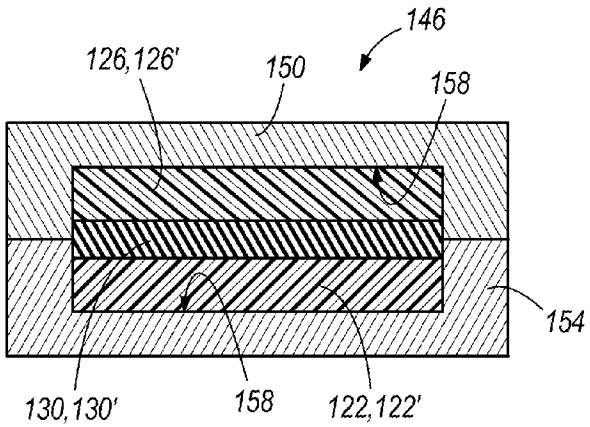
FIG. 4 is a schematic illustration of tooling for manufacturing a shower device, such as the shower head shown in FIG. 3.
Figure 5:
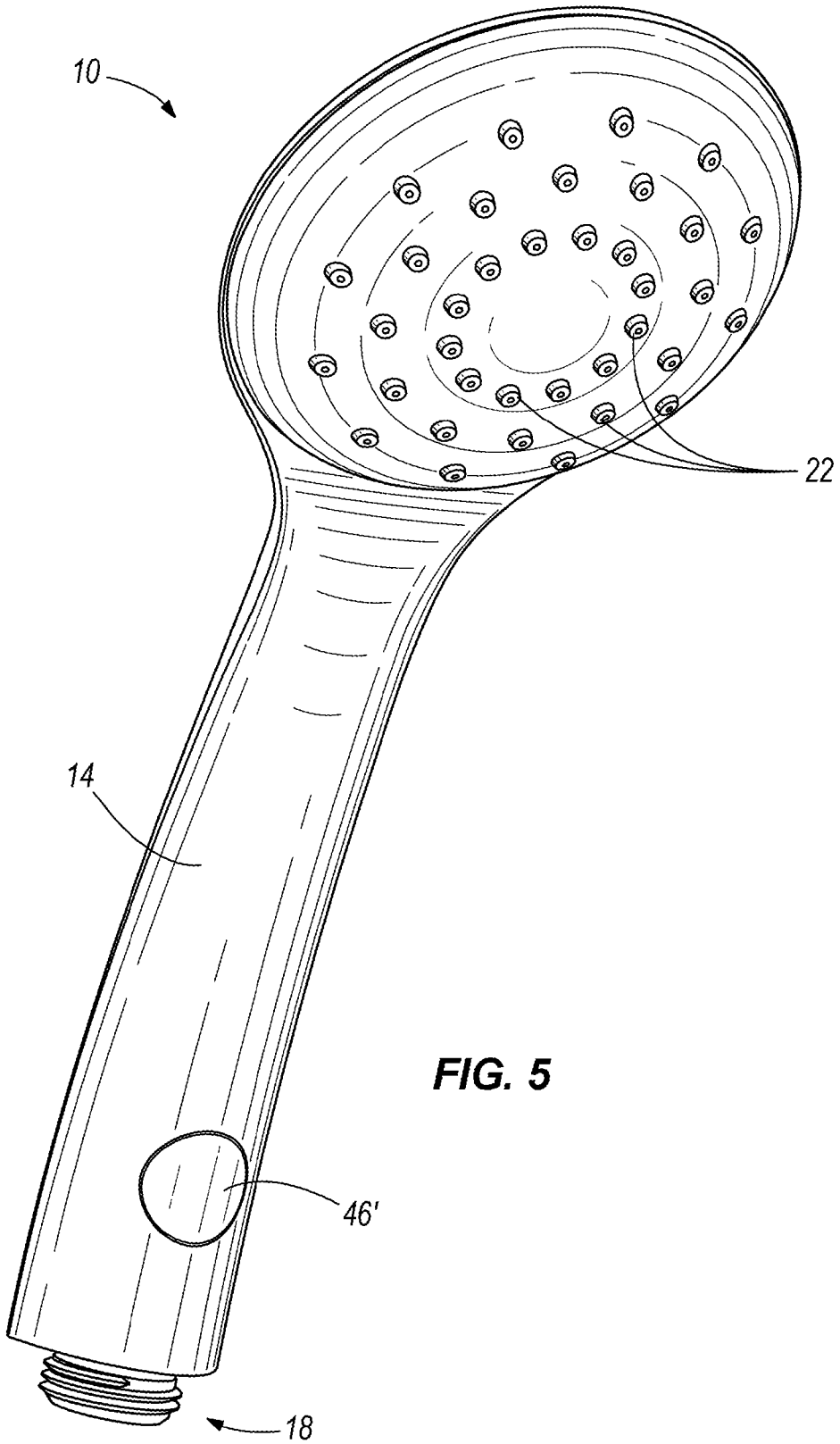
FIG. 5 is a perspective view of the shower device of FIG. 1 including an alternative construction for the button.
Figure 6:
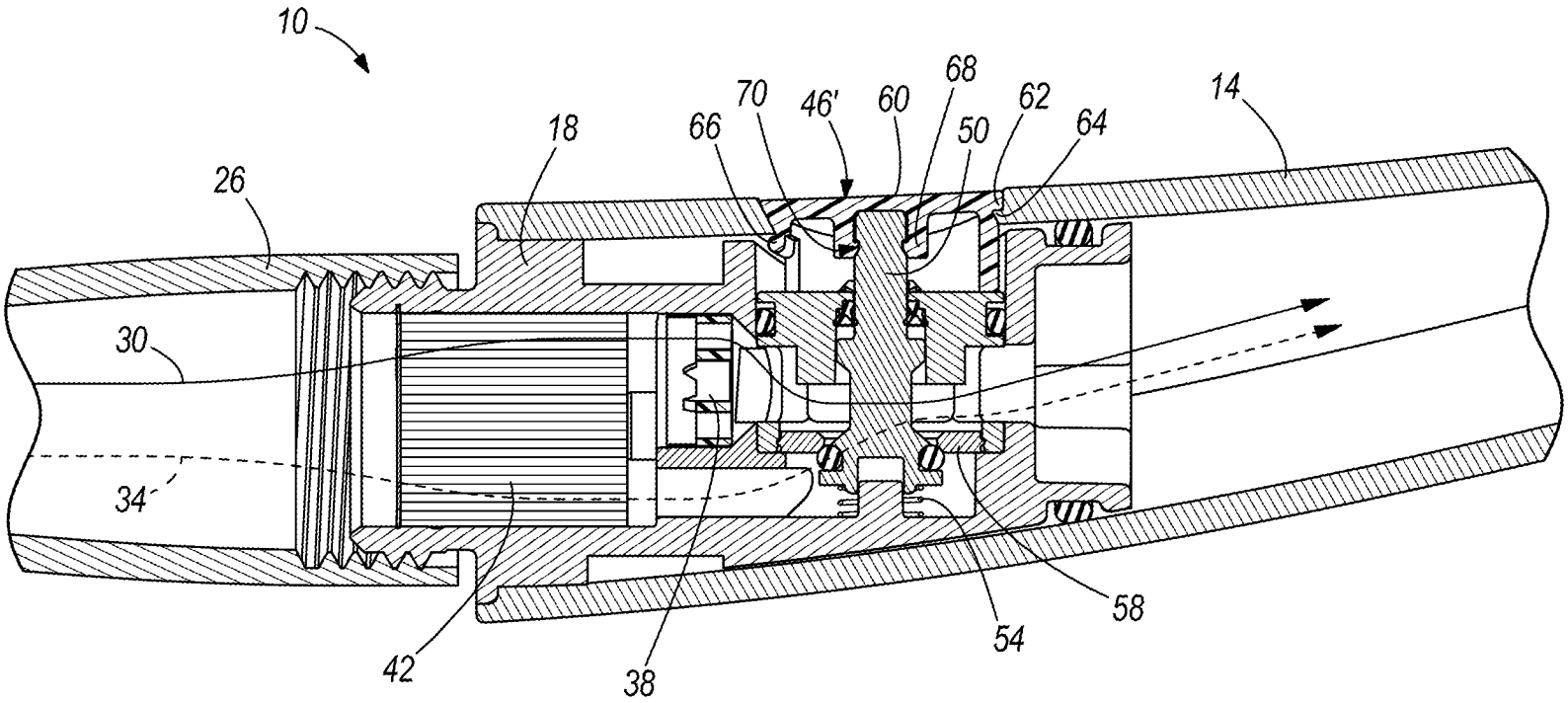
FIG. 6 is a cross sectional view of a portion of the shower device shown in FIG. 5 having the alternative button construction.

FIGS. 5 and 6 illustrate the shower device 10 including an alternative construction of an actuator or button 46'. The button 46' operates in substantially the same way as the button 46 described above, and the same reference numerals used in FIGS. 1-4 have been used in FIGS. 5-6 to indicate features that are the same as those described above.

The button 46' includes a flexible membrane 60 preferably formed of an elastomeric material, such as a thermoplastic elastomer, a thermoset elastomer or other suitable flexible and/or polymeric materials. The button 46' is flush, or below, the handle surface 14 to, for example, prevent accidental actuation, discourage tampering by holding the button 46' in the open, high flow position by tape, clamp or other means, etc. In other constructions (not shown), the button 46' may be recessed below the surface of the handle 14.

In particular, the membrane 60 is coupled to the handle 14 about its outer edges, or circumference. The outer edges of the membrane 60 are fixedly coupled to the handle 14 to discourage tampering by inserting objects between the button 46' and the housing 14 in an attempt to hold the button 46' in the high flow position. Portions of the outer edges of the membrane 60 include a groove 62 for receiving a lip 64 formed on the handle 14 to retain the outer edges of the membrane 60 with the handle 40 when the button 46' is depressed. Other portions of the outer edges of the membrane 60 include a ridge 66 engaging an inner surface of the handle 14 to inhibit peeling of the membrane 60 away from the handle 14 when the button 46' is released. When a user depresses the button 46', the membrane 60 flexes in the middle, forming a concave shape, as the outer edges remain fixed with the handle 14. In other constructions (not shown), other structures for fixing the outer edges of the button 46' to the handle 14 may be employed.

The button 46' is fixedly coupled to the valve member 50. In the illustrated construction, the button 46' and valve member 50 are fixedly coupled by way of a mating ridge 68 and groove 70. In other constructions (not shown), other mating features may be employed.

As with the button 46 described above, when the button 46' is in the depressed, or actuated position, the shower device 10 is placed in a high flow mode temporarily until the button 46' is released. The valve member 50 and the membrane 60 are biased to the low flow mode position, e.g., by water pressure and/or by the spring 54. In the low flow mode position, the membrane 60 is relatively flat and flush, or nearly flush, with the surface of the handle 14 (or the housing) of the shower device 10 to inhibit fixation of the shower device 10 in the high flow mode. Accordingly, the high flow mode can only be used "momentarily" while the button 46' is intentionally actuated by the user.

As also described above, when a user depresses the button 46', the supplemental flow path 34 is opened, causing an incremental increase in flow from the outlet nozzles 22. The secondary regulator 42 prevents the sum of the primary and supplemental flow paths 30, 34 from exceeding a specified flow rate. Thus, the supplemental flow path 34 adds to the flow from the shower device 10 when a user depresses the button 46'. When a user releases the button 46', the supplemental flow path 34 is automatically closed by the water pressure (and by the spring 54, if provided) acting upon the valve member 50 to move the valve member 50 into engagement with the valve seat 58 to close the supplemental flow path 34. Thus, the shower device 10 returns to the low flow mode upon release of the button 46'.

Thus, the invention may generally provide, among other things, a water-saving shower device 10 having a primary (low flow) flow path 30 and a selectively actuatable supplemental flow path 34 that supplements the primary flow path 30 to increase the total flow through the device 10. The illustrated shower device 10 defaults to the low flow mode, which is used during most of the duration of showering. For the shampoo rinsing task or other high-flow tasks, there is a flow control (through the button 46, 46') which allows a momentary increased flow rate while manually activated, and release of the flow control button 46, 46' returns the device to the lower flow default setting. The illustrated flow control is tamper resistant and not activated by normal usage of the product. Activation must be intentional and not likely to be used except momentarily. For the majority of usage of the shower device 10, actual water consumption of the device 10 is less than the maximum flow capability.

Figure 3:
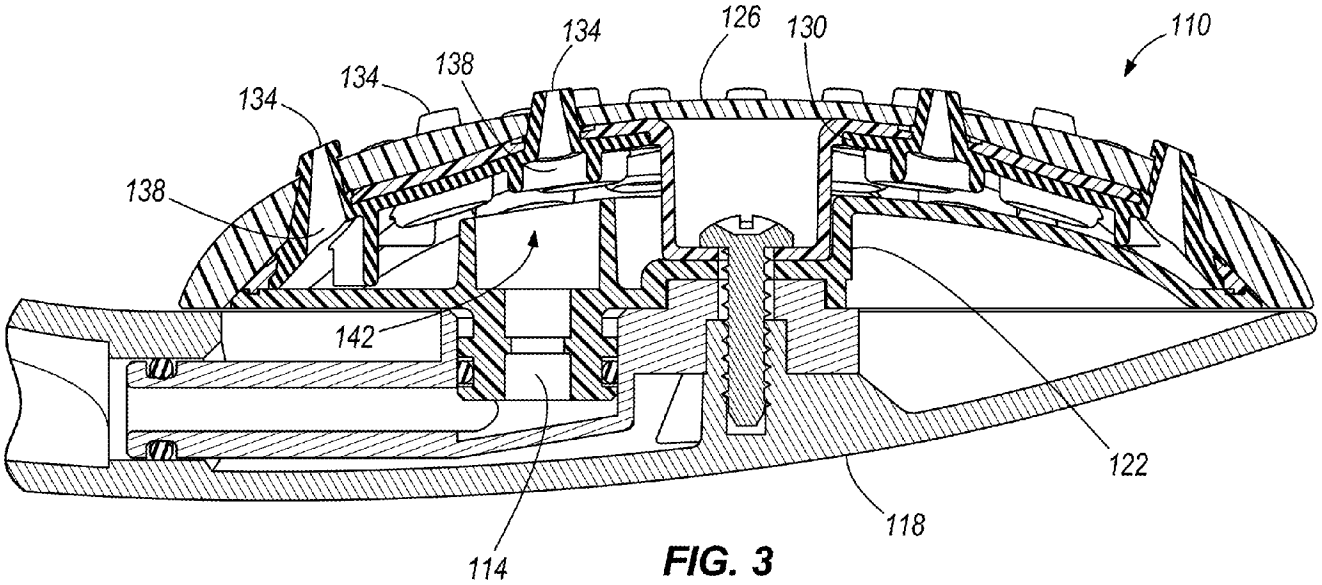
FIG. 3 is a cross sectional view of a portion of another shower device, such as a shower head.

FIG. 3 illustrates a shower head 110 having an inlet conduit 114, a shower body 118, a support base 122, an outer spray face 126 and an elastomeric insert 130 disposed between the support base 122 and the outer spray face 126. The illustrated spray face 126 is formed of a transparent material, such as a transparent thermoplastic material. The insert 130 includes nozzles 134 formed therein. The nozzles 134 are formed as conical-shaped apertures. The support base 122 also includes apertures 138 that are aligned with the nozzles 134 to cooperatively form the nozzles 134. A plenum chamber 142 is formed between the inlet conduit 114 and the support base 122 and provides a space for distributing water from the inlet conduit 114 to the outlet nozzles 134.

In some constructions, the insert 130 may be formed of silicone rubber and may be molded between the support base 122 and the outer spray face 126, which are formed from thermoplastic. Thus, the outer spray face 126 and the support base 122 may be joined together by the elastomeric insert 130. As such, the illustrated insert 130 may be both a functional component as well as a fastener for attaching the support base 122 to the outer spray face 126.

This allows for greater design flexibility and reduced assembly costs. This design allows use of a transparent spray face 126 through which the elastomeric insert 130 can be seen but without exposing unsightly ribs, weld joints, seams, etc. This design provides a method for attaching the clear or translucent spray face 126 to the exterior of the device 110 by chemical and/or physical bonding, thus eliminating the need for fasteners, joints, welds, etc.

Various other methods have been used to minimize the appearance of fasteners, joints and welds, typically, by covering, painting, or otherwise hiding the aesthetic flaw. Hiding fasteners by covering or obscuring them from view necessitates the use of another component (cover, decorative layer, film, etc.) and/or process. The above-described fastening method eliminates the need to hide fasteners, opening the aesthetic design to transparent or translucent spray faces 126. Further, the above-described fastening method and construction accomplish the functions of sealing, bonding and/or forming of the spray nozzles 134 generally within a single step.

The elastomeric insert 130 could be molded in such a way that it protrudes through (or is exposed through) the support base 122 which could facilitate using the elastomeric surface as a sealing surface, separating individual flow passages for multi-function spray heads, etc. This method could use insert molding, multi-shot injection molding, etc., and could use thermoplastic injection molding, liquid injection molding, a hybrid of the two, etc.

FIG. 4 is a schematic illustration of tooling 146 for manufacturing the shower device, such as the shower head 110 shown in FIG. 3. The tooling 146 includes a first mold half 150 and a second mold half 154 defining a tooling surface 158 configured to come into contact with the product being manufactured. A metallic additive (metallic flakes, fibers, etc.) is added to one or more substrates 122', 126', e.g., the support base 122 and the outer spray face 126, intended for insert, transfer or multi-shot over-molding. The metallic additive increases the ability of the substrate to be a reservoir of thermal energy (heat capacity) and to readily release the energy (thermal conductivity) for the rapid vulcanization of silicone rubber 130' (e.g., vulcanization of the insert 130). Thus, a method is provided to mold silicone rubber 130' between thermoplastic parts 122', 126', in which the silicone is largely not in contact with the tooling surface 158.

Many applications currently employ the over-molding silicone onto thermoplastic substrates. This provides a permanent bond between the substrate and the rubber and is particularly useful for sealing application in which an integral seal is desired. In processing silicone rubber, the tooling is generally heated to accelerate the vulcanization of the rubber. Over-molding thin sections of silicone onto plastic parts is possible because the silicone is exposed to the hot tool surface on at least one side.

In cases in which a silicone rubber layer 130' is between two thermoplastic parts 122', 126', as illustrated in FIG. 4, the insulative properties of the thermoplastic parts inhibit the vulcanization process. By changing the thermal properties of the thermoplastic parts, the thermoplastic parts 122', 126' better hold thermal energy and become, in essence, an extension of the tooling surface 158, both holding and transmitting heat from the mold tooling 146 to the silicone 130' and facilitating vulcanization.

It is common practice to preheat thermoplastic parts prior to over-molding, in an attempt to maximize adhesion properties. However, this method falls short in that thermoplastic substrates often have low heat capacity and poor thermal conductivity. If vulcanization were possible, it would require much more time to do so. Thus, current technology does not permit the molding of silicone rubber between two insulative thermoplastic layers. This would require at least partial exposure of the silicone to the heated tool surface to facilitate vulcanization.

The following equation relates to conductive heat transfer (q):

$$q=kAdT/s \quad \text{(Equation 1)}$$

where

A=heat transfer area, k=thermal conductivity of the material, dT=temperature difference across the material, and s=material thickness.

The following equation relates to specific heat capacity (c) (the amount of heat required to change a unit mass of a substance by one degree in temperature):

$$c=dQ/mdt \quad \text{(Equation 2)}$$

where dQ=heat supplied, m=mass, and dt=temperature change.

The following is the equation above (Equation 2), rewritten in terms of heat dQ:

$$dQ=mcdt \quad \text{(Equation 3)}$$

In regard to equations 1, 2 and 3, the method raises the energy available (q) to facilitate rapid vulcanization by increasing mass (m), specific heat capacity (c) and thermal conductivity (k) of the thermoplastic substrate 122', 126'.

The additives used to enhance the thermal properties may also provide a means of heating these parts in the tool 146, perhaps by electromagnetic energy. This could eliminate the need for preheating the substrates 122', 126' before loading them into the tool 146.

The present method would apply also to multi-shot processes, in which the thermoplastic 122', 126' and elastomeric components 130' would be created sequentially within the same tool 146. Residual heat from the thermoplastic molding process would be retained in the substrates 122', 126' and could facilitate vulcanization of the subsequent rubber component 130'.

The elastomeric component 130' could be molded in such a way that it protrudes through (or is exposed through) one or more of the substrates 122', 126'. This could facilitate using the elastomeric surface 130' as a sealing surface, separating individual flow passages for multi-function spray heads.

Thus, the invention may generally provide a method of manufacturing a product having an elastomeric component sandwiched between two thermoplastic components.

One or more independent features and independent advantages may be set forth in the following claims:

We claim:

1. A shower device comprising:

a housing having an inlet and an outlet, the housing defining a first flow path and a second flow path between the inlet and the outlet;

a first self-closing flow regulator positioned in the first flow path and limiting a flow of water therethrough to a first flow rate; and a second self-closing flow regulator positioned upstream of the first flow regulator and limiting a flow of water therethrough to a second flow rate, the first flow path and the second flow path passing through the second flow regulator, the second flow rate being greater than the first flow rate.

2. The shower device of claim 1, wherein the shower device includes a hand shower, the hand shower including a handle at least partially providing the housing.

3. The shower device of claim 1, and further comprising a valve positioned in the second flow path, the valve selectively closing the second flow path.

4. The shower device of claim 3, wherein the valve includes a valve seat and a valve member engageable against the valve seat to close the second flow path.

5. The shower device of claim 4, wherein water in the second flow path biases the valve member to the closed position.

6. The shower device of claim 5, and further comprising a spring biasing the valve member to the closed position.

7. The shower device of claim 4, wherein the shower device further comprises an actuator operable to move the valve member from a closed position, in which the second flow path is closed, to an open position, in which the second flow path is open.

8. The shower device of claim 7, wherein the housing has a surface, and wherein the actuator is positioned on the housing one of flush with and recessed from the surface of the housing.

9. The shower device of claim 7, wherein the actuator includes a flexible membrane having outer edges fixedly coupled to the housing, the flexible membrane flexing between a first position, corresponding to the closed position of the valve member, and a second position, corresponding to the open position of the valve member.

10. A shower device comprising:

a housing having an inlet and an outlet;

a first flow passage communicating between the inlet and the outlet and configured to provide a first flow rate of water; and a second flow passage communicating between the inlet and the outlet and configured to provide a second flow rate of water;

wherein the shower device is operational in a low flow mode, to provide water through the first flow passage at the first flow rate, and in a high flow mode, to provide water through the first flow passage and the second flow passage at a total flow rate, the total flow rate being a sum of the first flow rate and the second flow rate; and wherein a water pressure in the second flow passage is configured to bias the shower device to the low flow mode.

11. The shower device of claim 10, and further comprising:

a first flow regulator positioned in the first flow passage and limiting a flow of water therethrough to the first flow rate; and a second flow regulator positioned upstream of the first flow regulator and limiting a flow of water therethrough to the total flow rate, the first flow passage and the second flow passage communicating with the second flow regulator.

12. The shower device of claim 10, wherein the shower device includes a hand shower, the hand shower including a handle at least partially providing the housing.

13. The shower device of claim 10, and further comprising a valve positioned in the second flow passage, the valve selectively closing the second flow passage.

14. The shower device of claim 13, wherein the valve includes a valve seat and a valve member engageable against the valve seat to close the second flow passage.

15. The shower device of claim 13, wherein water in the second flow passage biases the valve member to the closed position.

16. The shower device of claim 15, and further comprising a spring biasing the valve member to the closed position.

17. The shower device of claim 14, wherein the shower device further comprises an actuator operable to move the valve member from a closed position, in which the second flow passage is closed, to an open position, in which the second flow passage is open.

18. The shower device of claim 17, wherein the housing has a surface, and wherein the actuator is positioned on the housing one of flush with and recessed from the surface of the housing.

19. The shower device of claim 17, wherein the actuator includes a flexible membrane having outer edges fixedly coupled to the housing, the flexible membrane flexing between a first position, corresponding to the closed position of the valve member, and a second position, corresponding to the open position of the valve member.

20. A hand shower device comprising:

a handle having a surface;

a primary flow path for directing a first portion of fluid flow;

a supplemental flow path for directing a second portion of the fluid flow;

a valve positioned in the supplemental flow path and operable to close the supplemental flow path; and a manually engagable actuator coupled to and in contact with the valve and manually operable to open the valve, the actuator being positioned on the handle one of flush with and recessed from the surface of the handle;

wherein the shower device is operational in a low flow mode to provide the first portion of fluid flow through the primary flow path, and in a high flow mode to provide a sum of the first portion and the second portion, the first portion of the fluid flow being provided through the primary flow path in the high flow mode and the second portion of the fluid flow being provided through the supplemental flow path in the high flow mode.

21. The shower device of claim 20, wherein the actuator includes a flexible membrane having outer edges fixedly coupled to the housing, the flexible membrane flexing between a first position, corresponding to the closed position of the valve member, and a second position, corresponding to the open position of the valve member.

22. The shower device of claim 20, and further comprising:

a first flow regulator positioned in the primary flow path and limiting a flow of water therethrough to the first flow rate; and a second flow regulator positioned upstream of the first flow regulator and limiting a flow of water therethrough to the total flow rate, the primary flow path and the supplemental flow path communicating with the second flow regulator.

23. The shower device of claim 20, wherein the valve includes a valve seat and a valve member engageable against the valve seat to close the supplemental flow path.

24. The shower device of claim 23, wherein water in the second flow passage biases the valve member to the closed position.

25. The shower device of claim 24, and further comprising a spring biasing the valve member to the closed position.

26. A shower device comprising:

a housing;

a primary flow path for directing a first portion of fluid flow;

a supplemental flow path for directing a second portion of the fluid flow;

a valve positioned in the supplemental flow path and operable to close the supplemental flow path; and a manually engagable actuator coupled to the valve and manually operable to open the valve, the actuator including a flexible membrane having outer edges fixedly coupled to the housing, the flexible membrane flexing between a first position, in which the supplemental flow path is closed, and a second position, in which the supplemental flow path is open;

wherein the shower device is operational in a low flow mode to provide the first portion of fluid flow through the primary flow path, and in a high flow mode to provide a sum of the first portion and the second portion, the first portion of the fluid flow being provided through the primary flow path in the high flow mode and the second portion of the fluid flow being provided through the supplemental flow path in the high flow mode.

27. The shower device of claim 26, wherein the valve includes a valve seat and a valve member engageable against the valve seat to close the supplemental flow path.

28. The shower device of claim 26, wherein water in the second flow passage biases the valve member to a closed position.

29. The shower device of claim 28, and further comprising a spring biasing the valve member to the closed position.

30. The shower device of claim 26, and further comprising:

a first flow regulator positioned in the primary flow path and limiting a flow of water therethrough to a first flow rate; and a second flow regulator positioned upstream of the first flow regulator and limiting a flow of water therethrough to a second flow rate, the primary flow path and the supplemental flow path passing through the second flow regulator, the second flow rate being greater than the first flow rate.

31. The shower device of claim 26, wherein the shower device includes a hand shower, the hand shower including a handle at least partially providing the housing.

* * * * *